United States Patent [19]

Khan

[11] Patent Number: 4,886,521

[45] Date of Patent: Dec. 12, 1989

[54] DECAKING OF COAL OR OIL SHALE DURING PYROLYSIS IN THE PRESENCE OF IRON OXIDES

[75] Inventor: M. Rashid Khan, Morgantown, W. Va.

[73] Assignee: U.S. Department of Energy, Washington, D.C.

[21] Appl. No.: 190,429

[22] Filed: May 5, 1988

[51] Int. Cl.[4] ..... C10L 5/00; C10L 9/00

[52] U.S. Cl. ..... 44/607; 44/620; 201/9; 201/35; 208/426

[58] Field of Search ..... 44/620, 905, 505, 591, 44/592, 607, 608; 208/400, 426; 201/9, 35

[56] References Cited

U.S. PATENT DOCUMENTS

| | | | |
|---|---|---|---|
| 1,838,882 | 12/1931 | Trent | 201/9 |
| 1,850,022 | 3/1932 | Maruhn et al. | 208/400 |
| 2,285,276 | 6/1942 | Hemminger | 208/426 |
| 3,725,038 | 4/1973 | Wenzel et al. | 44/591 |
| 4,173,454 | 11/1979 | Heins | 44/905 |
| 4,392,940 | 7/1983 | Tao | 208/426 |
| 4,427,529 | 1/1984 | Nishio | 208/426 |

FOREIGN PATENT DOCUMENTS

| | | | |
|---|---|---|---|
| 174493 | 10/1983 | Japan | 44/905 |

OTHER PUBLICATIONS

Loison et al., "The Plastic Properties of Coal", *Chemistry of Coal Utilization,* Lowry, Ed., Wiley, N.Y., (1963), pp. 150–209.

Cypres et al., "Pyrolysis of Coal and Iron Oxides Mixtures. 2. Reduction of . . . ", *Fuel,* vol. 60, pp. 33–39, (1981).

Khan et al., "Thermoplastic Properties of Coals Carbonized at . . . ", *Fuel Processing Technology,* vol. 8, pp. 307–311, (1984).

McKewan, "Reduction Kinetics of Magnetite in Hydrogen at High . . . ", *Trans. Metal. Soc. AIME,* vol. 224, pp. 387–393, (1962).

McKewan, "Reduction Kinetics of Hematite in Hydrogen—Water . . . ", *Trans. Metal. Soc. AIME,* vol. 224, pp. 2–5, (1962).

McKewan, "Reduction Kinetics of Magnetite in $H_2$—$H_2O$—$N_2$ Mixtures", *Trans. Metal. Soc. AIME,* vol. 221, pp. 140–145, (1961).

McKewan, "Kinetics of Iron Oxide Reduction", *Trans. Metal. Soc. AIME,* vol. 218, pp. 2–6, (1960).

McKewan, "Kinetics of Iron Ore Reduction", *Trans. Metal. Soc. AIME,* vol. 212, pp. 791–793, (1958).

"Physical Chemistry of Iron and Steel Making", *The Making, Shaping and Treating of Steel,* pp. 66–74.

Rosenqvist, *Principals and Eutectic Metallurgy,* pp. 270–279, McGraw—Hill, (1974).

Khan et al., *Fuel,* vol. 65, No. 9, pp. 1291–1299, (1986).

*Primary Examiner*—Carl F. Dees

*Attorney, Agent, or Firm*—Earl L. Larcher; Stephen D. Hamel; William R. Moser

[57] ABSTRACT

A method for producing a fuel from the pyrolysis of coal or oil shale in the presence of iron oxide in an inert gas atmosphere. The method includes the steps of pulverizing feed coal or oil shale, pulverizing iron oxide, mixing the pulverized feed and iron oxide, and heating the mixture in a gas atmosphere which is substantially inert to the mixture so as to form a product fuel, which may be gaseous, liquid and/or solid. The method of the invention reduces the swelling of coals, such as bituminous coal and the like, which are otherwise known to swell during pyrolysis.

19 Claims, 4 Drawing Sheets

DECAKING OF COAL OR OIL SHALE DURING PYROLYSIS IN THE PRESENCE OF IRON OXIDES

BACKGROUND OF THE INVENTION

This invention relates to the production of a fuel from the pyrolysis or gasification of coal or oil shale. In particular, this invention relates to the production of a fuel from the pyrolysis or gasification of coal or oil shale in the presence of iron oxide in an inert gas atmosphere.

Petroleum shortages and inflated prices for petroleum products have provided incentives to develop alternate energy sources. The processing of coal or oil shale to produce an alternate fuel is an important method for attempting to satisfy global energy needs. Processes for the production of such alternate fuels include fluidized bed and fixed bed pyrolysis or gasification of coal and the like. In a conventional system, coal is pulverized and heated in a reactor system in which the coal undergoes pyrolysis or gasification. An inherent problem with the pyrolysis process occurs when particles of bituminous coal are heated. Heat causes the individual particles to soften and swell up to as much as several hundred percent of their original volume. Prior to swelling, the particles undergo a slight contraction. The swollen particles promote agglomeration or caking which causes the entire coal mass to swell. The formation of agglomerated material is enhanced by the pressure influences exerted on the coal by a fluidized or fixed bed system. The agglomeration of coal particles forms hard chunks of cementitious material that tend to clog and plug up the pyrolysis reactor system. Although operation at elevated pressures generally improves the economics of the pyrolysis process and facilitates the use of reactors with smaller volumes, the agglomeration problem tends to become worse as the operating pressure increases. Thus the agglomeration phenomenon has limited the use of otherwise advantageous elevated pressures.

Other disadvantages are associated with the coal agglomeration problem. The agglomeration problem limits the types of coal that can be processed by the system to noncaking types of coal. Additionally, this problem precludes the use of a high-pressure system since the high pressure would enhance the clogging of the reactor. An economically viable high-pressure system would increase the efficiency of the entire process. A further disadvantage relates to the resultant coke product which forms a solid residue which is difficult to reuse as fuel.

A similar problem is encountered during attempts to pyrolyze oil shale. There is a strong tendency for the shale particles to soften and become sticky. This leads to agglomeration which at best inhibits the efficiency of the pyrolysis reaction and reduces the yield and at worst results in plugging of the pyrolysis reactor.

The industry lacks a method for pyrolyzing coal or oil shale under high pressure which prevents the agglomeration of the coal particles. It would also be desirable to have a method for pyrolyzing coal which increases the quality of the resulting alternate fuel products.

SUMMARY OF THE INVENTION

It is therefore an object of the present invention to provide a method for pyrolyzing coal or oil shale to produce a high-quality fuel.

it is also an object of the present invention to provide a method for preventing agglomeration of coal or oil shale during the pyrolysis process.

Another object of the present invention is to provide a method for preventing the swelling of coal or oil shale during pyrolysis.

It is a further object of the present invention to provide a method for preventing the plugging and clogging of a pyrolysis reactor during processing of coal or oil shale to an alternate fuel.

Another object of the present invention is to provide a method for pyrolyzing coal or oil shale under high pressure.

It is still another object of the present invention to provide a method for reducing the $H_2S$ and tar S content of liquid products of pyrolysis to provide a liquid fuel having an increased heating value.

Yet another object of the present invention is to provide a method for reducing the sulfur content of the tar by-product of coal pyrolysis.

It is also an object of the present invention to provide a method for reducing the sulfur and hydrocarbon gas content of the solid char product of pyrolysis.

Still another object of the present invention is to provide a process for obtaining elemental iron as a by-product of coal pyrolysis.

In accordance with one aspect of the present invention, these objects are achieved by a method for producing a fuel from the pyrolysis of coal or oil shale comprising the steps of (a) pulverizing coal or oil shale, (b) pulverizing iron oxide, (c) mixing the pulverized coal or oil shale and the pulverized iron oxide, (d) subjecting the pulverized mixture to a mechanical load, and (e) heating said mechanically loaded mixture to pyrolysis temperature in a gas atmosphere which is substantially inert to said mixture, so as to substantially prevent said mixture from swelling, to form a product fuel.

In accordance with another aspect of the present invention, these objects are achieved by a method for pyrolyzing coal or oil shale in the presence of iron oxide in an inert gas atmosphere under high pressure conditions.

In accordance with another preferred aspect of the invention, iron oxides are reduced to elemental iron by (a) pulverizing coal, (b) pulverizing iron oxide, (c) mixing said pulverized coal and said pulverized iron oxide, (d) heating said mixture in a hydrogen ($H_2$) gas atmosphere having a pressure greater than about 1 atmosphere, so as to reduce said iron oxide to elemental iron (Fe) and form a pyrolysis product, and (e) separating said elemenal iron from said pyrolysis product.

In yet another aspect of the invention, the swelling of coal during coal pyrolysis is reduced by (a) pulverizing coal, (b) pulverizing iron oxide, (c) mixing said pulverized coal and said pulverized iron oxide, (d) subjecting the pulverized mixture to a mechanical load, and (e) heating said mechanically loaded mixture to pyrolysis temperature in a gas atmosphere which is substantially inert to said mixture, so as to substantially prevent said mixture from swelling.

BRIEF DESCRIPTION OF THE DRAWINGS

Other objects features and advantages of the present invention will become apparent from the following detailed description and accompanying drawings wherein.

DETAILED DESCRIPTION OF PREFERRED EMBODIMENTS

Figure 1:
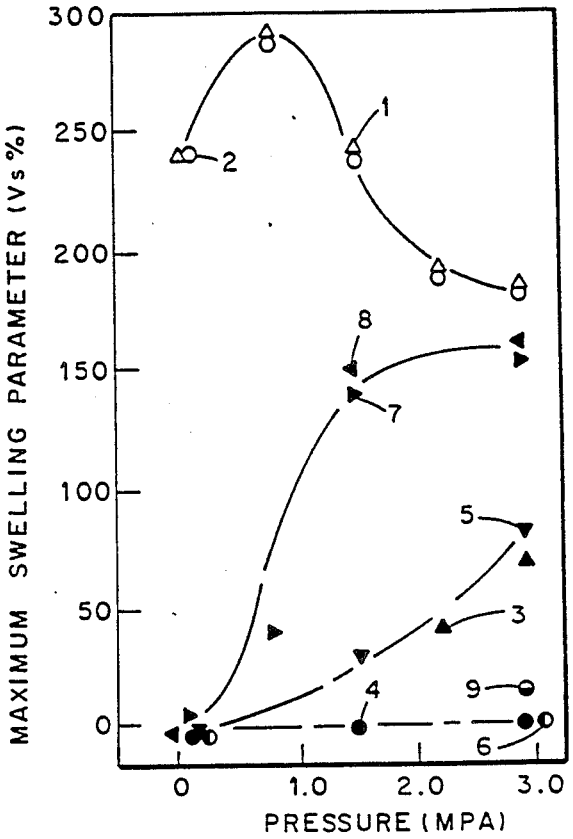
FIG. 1 is a graph which represents the effect of iron oxide additives on the maximum swelling parameter ($V_s$ %) at a first heating rate.

The present invention includes a method for producing a fuel from the pyrolysis of coal in the presence of iron oxide in an inert gas atmosphere. The method includes the steps of pulverizing feed coal or oil shale, pulverizing iron oxide, mixing the pulverized feed and pulverized iron oxide, subjecting the pulverized mixture to a mechanical load, and heating the mechanically loaded mixture to pyrolysis temperature in a gas atmosphere which is substantially inert to the mixture, so as to substantially prevent the mixture from swelling, whereby at least one product fuel is formed. Product fuels may be gaseous, liquid and/or solid products.

The iron oxide additive can include hematite ($Fe_2O_3$) and/or magnetite ($Fe_3O_4$) and the method can be practiced under conditions of high pressure. As used herein the term "high pressure" refers to a pressure above atmospheric pressure. The process may advantageously be carried out, for example, at pressures ranging from about 1 to 35 atmospheres. Preferably the pyrolysis is carried out at a superatmospheric pressure, particularly above about 2 atmospheres and most preferably above about 10 atmospheres. It is especially preferred to operate in the range from about 25 to 25 atmospheres, especially in fixed-bed gasifiers. An acceptable gas atmosphere is one which exhibits great stability and an extremely low reaction rate under the pyrolysis reaction conditions, thereby remaining substantially inert to the mixture, and can include, but is not limited to, helium (He), hydrogen ($H_2$) and nitrogen ($N_2$). Additionally, the method of the present invention is applicable to other heating processes such as gasification and the like and applicable to other raw materials such as oil shale and the like.

The coal or oil shale is desirably pulverized to less than 100 mesh size (150 μm). Preferably the coal or oil shale is reduced to less than 200 mesh size (74 μm). Similarly the iron oxide additive is desirably pulverized to less than 200 mesh size (74 μm) and preferably to less than 400 mesh size (38 μm). Use of coarser material does not produce the same advantageous reduction in swelling during pyrolysis.

The pulverized mixture is subjected to a mechanical load before and during the pyrolysis. This may suitably be accomplished in a simple manner by applying weights on top of the pulverized coal/iron oxide mixture in the pyrolysis reactor. The amount of load applied may vary. Typically the load will be from about 5 to about 50 kPA (kilopascals), preferably from about 8 to about 20 kPa, particularly at least about 10 kPa.

Without being bound to a particular theory, it is believed that the fine particle sizes and mechanical load function to improve physical contact between the finely divided coal or oil shale and the finely divided iron oxide additive.

The method according to the present invention reduces the swelling of coals, such as bituminous coal and the like, which are of the type known to swell during pyrolysis. A reduction in swelling prevents the coal from agglomerating and forming a hardened mass known as coke. The reduced swelling of the coal also prevents the clogging and plugging of the pyrolysis reactor during processing. The adverse effects exerted on the coal by the pressure of a fluidized or fixed bed system which normally promotes agglomeration are minimized by the present invention. The method of the present invention also reduces the amount by which the coal contracts prior to swelling.

Additional advantages can be derived from preventing the swelling of coal during pyrolysis. One advantage provided by the present invention is the ability to use highly caking coal in the pyrolysis process. The ability to use highly caking coal increases the types and amount of coal available for alternate energy production.

Another advantage is the ability to pyrolyze coal in a high pressure system. The use of a high pressure system increases the economic benefit derived from the pyrolysis process.

A further advantage offered by the present invention is the reduction of the hydrogen sulfide ($H_2S$) and tar S content in liquid fuel products of coal pyrolysis. The decrease in the amount of these compounds provides a liquid fuel having an increased heating value. Additionally, the sulfur content of the tar itself is reduced.

Another advantage of the present invention is the ability to use the solid char residue as a fuel. The solid char residue maintains the same particle size as the feed coal. This char residue can ultimately be pulverized and used as fuel.

Elemental iron can be recovered from the system when high pressure hydrogen gas is utilized in the pyrolysis process.

EXPERIMENTAL PROCEDURE:

Analysis of the coal pyrolyzed in accordance with the present invention was performed by use of a commercially available instrument known as a high-pressure microdilatomer (HPMD) system. A detailed evaluation and description of the HPMD system and a description of the parameters it measures are provided in Khan, Masters Thesis, The Pennsylvania State University, (1981); Khan, Doctoral Thesis, The Pa. State University (1985), Khan et al, *Fuel,* Vol. 63, pp. 109–115, (1984), which are incorporated by reference herein.

Samples of a Lower Kittanning seam, 1vb coal (PSOC 1197) were utilized in the examples and represent coal of the type known to swell during pyrolysis, such as bituminous coal. Ultimate and proximate analyses of the PSOC 1197 coal are as follows: (a) proximate analysis (as received)—$H_2O$, 0.7%; ash, 10.3%; volatile matter (VM), 16.4%; and free carbon (FC), 72.6%; (b) ultimate analysis (daf basis)—C, 89.6%; H, 4.6%; N, 1.8%; S, 1%; and FSI, 5%.

The coal was ground and sieved in an $N_2$ atmosphere to minimize oxidation during preparation. The raw, untreated coal was dried in ultra-high purity (UHP) $N_2$ for about one hour at a temperature of about 383° K. (degrees Kelvin). The following additives were utilized: Nonporous silica ($SiO_2$) (Baker Chemical, 99.5%) (comparative example); $Fe_2O_3$ and $Fe_3O_4$ (Baker Chemical, 99.9%). All additives were ground and sieved to less than about 400 mesh, a size equivalent to less than about 38 microns (μm). Subsequently, the additives were dried in a vacuum under a pressure of about $10^{-4}$ megapascals (MPa) at a temperature of about 383° K. $SiO_2$ (comparative example) was heated ot a temperature of about 773° K. for about one hour to remove any silanol groups present on the surface. A mixture of coal and an additive was prepared by stirring the components together for about 30 minutes followed by overnight slow shaking of the mixture. The mixture was then placed in the HPMD system and a predetermined mechanical load was applied by placing weights on top of the powder mixture. All experiments were conducted at a controlled heating rate to various maximum temperatures in the presence of an inert gas atmosphere.

The experimental conditions utilized to conduct the dilatometric runs, as more fully appear in the Examples below, were as follows: a pressure range of from about 0.1 to about 3.6 MPa in an He or $H_2$ atmosphere, a heating rate of either about 5° or 60° K./minute, a coal particle size of less than about 74 μm, and an applied mechanical load of about 9.8 kilopascals (kPa). The concentrations of the additives utilized in the following Examples, reported in weight percent (wt %) and in millimoles iron per gram of coal (mmole Fe/g coal), are listed in Table 1.

TABLE 1

| | Concentrations of $Fe_2O_3/Fe_3O_3$ Utilized | |
|---|---|---|
| | Wt % Added | mmole Fe/g coal |
| $Fe_2O_3$ | 5.8 | 0.72 |
| | 23.2 | 2.9 |
| $Fe_3O_4$ | 5.6 | 0.72 |
| | 22.3 | 0.72 |
| $SiO_2$ | 5 (Comparative Example) | — |
| | 20 (Comparative Example) | |

The parameters measured by the HMPD system used in the following Examples are as follows:

a. Maximum volume swelling parameter (Vs %),
b. Volume contraction parameter (Vc %),
c. Volume change upon resolidification parameter (Vr %), and
d. Characteristic temperature parameters: softening (Ts); contraction (Tc); maximum swelling (Te); and resolidification (Tr).

Coal weight loss during pyrolysis was determined by weighing the samples before and after each experimental run. The volumetric parameters are expressed on a percentage basis, based on the initial volume of the coal utilized. The maximum swelling parameter (Vs %) is defined by the following equation in all cases:

$$Vs\ \% = \frac{\text{volume of expanded coal sample} - \text{initial volume}}{\text{initial volume of coal sample}} \times 100$$

The volume occupied by the additives is not entered into the equation above, thereby normalizing the reported data to a coal-alone basis.

EXPERIMENTAL RESULTS AND DISCUSSION:

The following experimental results were noted by practicing the method of the present invention:

The volumetric changes during heat-treatment observed for iron oxide alone were insignificant as compared to the volumetric changes noted for the coal. Heat-treatment of the additives alone showed no weight loss when heated to a temperature of about 923° K. The Vs parameter can be reproduced to within ±6%, the Vc parameter can be reproduced to within ±3% and the characteristic temperatures can be reproduced to within ±6° K.

Additives may have a diluent or a catalytic role in pyrolysis, as is described in detail in Khan, Doctoral Thesis, The Pennsylvania State University, (1985), which is incorporated by reference herein. As a comparative example, dry mixed nonporous $SiO_2$ was utilized in the method of the present invention to separate "diluent" effects of various additives from their potential chemical/catalytic effects. The observed effects of additions of 20 wt % $SiO_2$ on the resulting thermoplastic parameters of the coal (PSOC 1197, 1 vb) are relatively small (see Khan, Doctoral Thesis, The Pennsylvania State University, (1985); Khan et al, *Proceedings,* 1983 *International Conference on Coal Science, IEA,* Pittsburgh, Pa., pp. 495–498; and Khan et al, *Fuel,* 65 No. 9, pp, 1291–1299 (1986)) which are incorporated by reference herein. These results indicate that $SiO_2$ serves primarily as a diluent.

The diluent effect of $SiO_2$ on the thermoplastic properties of coal may result from the presence of $SiO_2$ particles in the plastic mass which cause an increase the permeability of gas flow and thereby slightly reduce the internal "swelling pressure." In addition, the presence of a $SiO_2$ particle between two softened coal particles slightly inhibits fusion of the coal particles since $SiO_2$ does not soften under the conditions of the pyrolysis process. Therefore, these factors combine to provide a slight reduction in the overall agglomeration of the coal-bed. The slight reduction in swelling attributable solely to the diluent effect of an additive provides a baseline by which to evaluate the chemical/catalytic effect of the additives of the present invention.

FIG. 1 shows the effects of the addition of various concentrations of hematite ($Fe_2O_3$) or magnetite ($Fe_3O_4$) as compared to coal heated at this heating rate without the added concentrations of iron oxides as shown by line 1 for heating in an atmosphere of $H_2$ or line 2 for heating in an atmosphere of He on Vs in an $H_2$ or He atmosphere having a heating rate of about 60° K./minute. Addition of hematite or magnetite at concentrations of about 0.72 mmole Fe/gram, as respectfully supplied by about 5.8 wt % $Fe_2O_3$ in $H_2$, line 7 and 5.6 wt % $Fe_3O_4$ in $H_2$, line 8 and in He, line 9, or concentrations of about 2.9 mmole Fe/gram coal, as supplied by about 23.2 wt % $Fe_2O_3$ in $H_2$, line 3 and in He, line 4 or 22.3 wt % $Fe_3O_4$ in $H_2$, line 5 and in He, line 6, respectively, eliminates the Vs parameter at a pressure of about 0.1 MPa in an $H_2$ or He atmosphere. However, Vs is significantly restored at elevated pressures of $H_2$, depending on the quantity of the additives utilized. This result will be described in detail below. Generally, the higher the loading of the additives, the lower the Vs parameter. Although Vs appears to be slightly larger at all pressures in the presence of magnetite as compared to the presence of hematite, the observed variations are within the experimental errors of measurement. The effect of these iron oxide additives in a He atmosphere is to eliminate Vs totally by producing a thermosetting (non-softening or non-swelling) solid material.

Figure 2:
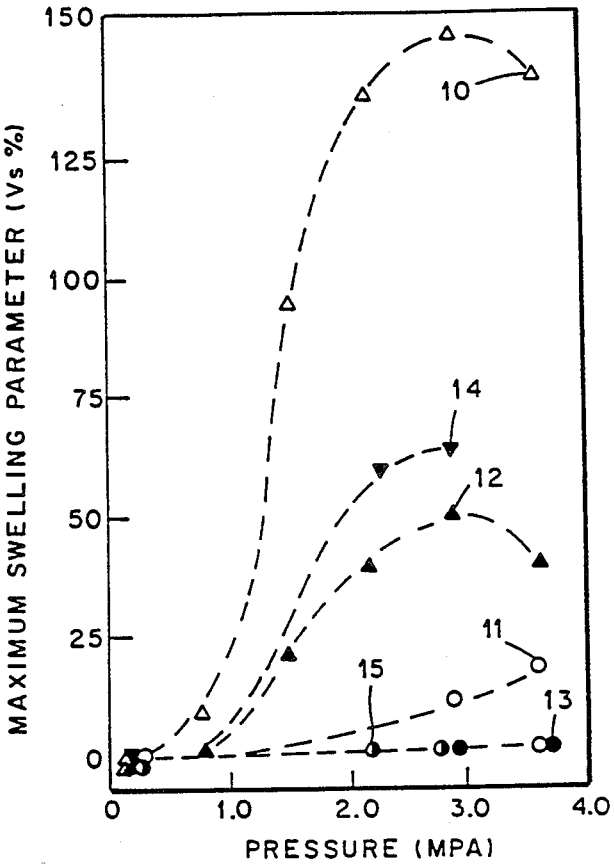
FIG. 2 is a graph which represents the effect of iron oxide additives on the maximum swelling parameter ($V_s$ %) at a second heating rate.

FIG. 2 shows the effects of iron oxide on the Vs parameter at a heating rate of about 5° K./minute in FIG. 2 comparative examples of coal without iron-oxide additives were subjected to this heating rate in $H_2$, line 10, and in He, line 11. Heating comparisons with this untreated coal were made with coal having about 23.2 wt. % $Fe_2O_3$ in $H_2$, line 12, and in He, line 13, and with coal having 22.3 wt. % $Fe_3O_4$ in $H_2$, line 14 and in He, line 15. As noted at a heating rate of 60° K./minutes, pyrolysis of coal at a heating rate of about 5° K./minute in the presence of iron oxide eliminates Vs at all pressures of He. The coal, in the presence of He acts as a thermosetting material. Visual examination of the resulting coke shows no evidence of softening or agglomeration.

When coal is pyrolyzed in the presence of iron oxide additives in $H_2$ at a heating rate of about 5° K./minute, the resulting coke visually apears to be more fused and agglomerated than the coke produced by the pyrolysis of untreated coal in an He atmosphere. It can be seen in FIG. 2, however, that Vs in an $H_2$ atmosphere for the iron-oxide loaded coal is significantly lower than that for the untreated coal (comparative example) in $H_2$. This decrease in Vs in an $H_2$ atmosphere is attributable to the increased fluidity of the coal-melt during pyrolysis. Apparently, the coal passes through a highly fluid intermediate phase during pyrolysis in the presence of iron oxide in an $H_2$ atmosphere. A highly fluid-melt is unable to "trap" volatiles which are necessary for the high degree of swelling exhibited by the untreated coal (comparative example). This accounts for the reduction in swelling of the coal in the presence of iron oxide in $H_2$ as compared to the swelling of the untreated coal in an $H_2$ atmosphere. As disclosed in detail below, at a heating rate of about 5° K./minute in an $H_2$ atmosphere, the iron oxides are partly reduced to elemental iron which facilitates hydrogenation and ultimately leads to a highly fluid-melt.

Figure 3:
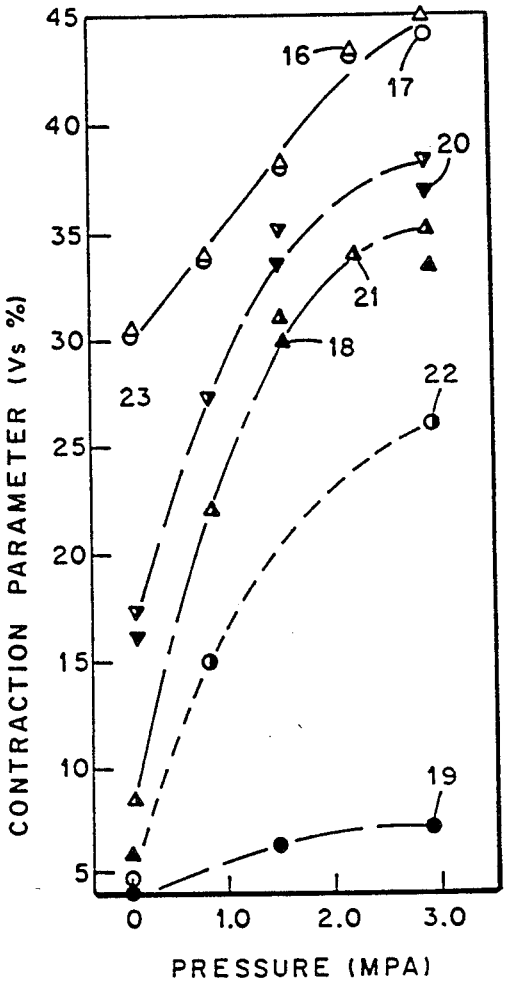
FIG. 3 is a graph which represents the effect of iron oxide additives on the contraction parameter ($V_c$ %)

FIG. 3 shows the effect of the addition of hematite or magnetite on the Vc parameter as a function of the loading of iron oxide additives in an $H_2$ or He atmosphere at a heating rate of about 60° K./minute. The data in the graph in FIG. 3 illustrates the dramatic effect that the addition of iron oxide has on the Vc parameter. In FIG. 3, lines 16 and 17 are directed to untreated coal heated at this heating rate in $H_2$ and in He, respectfully. Comparisons of this untreated coal were made at this heating rate with coal having about 23 wt. % $Fe_2O_3$ in $H_2$, line 18 and in He, line 19. Coal with about 6 wt. % $Fe_2O_3$ heated in $H_2$ is at line 20. Coal with 22.3 wt. % $Fe_3O_4$ as heated in $H_2$, line 21 and in He, line 22 is compared to the untreated coal, lines 16 and 17, at this heating rate. Line 23 represents coal with 5.6 wt. % $Fe_3O_4$ heated in $H_2$. Specifically, the Vc parameter is reduced from about 30% to less than about 5% at a pressure of about 0.1 MPa in an $H_2$ or He atmosphere. However, Vc is significantly restored to varying degrees at elevated pressures of about 2.0 MPa, and is dependent on the type of gas atmosphere, and the quantity and quality of the additive utilized.

In general, the greater the loading of the iron oxides, the lower the Vc parameter. The Vc parameter is smaller in a He atmosphere than in an $H_2$ atmosphere. Additionally, for identical loading of the additives, the Vc parameter is slightly lower for $Fe_2O_3$ than for $Fe_3O_4$.

The influence of the iron oxide additives on the Vc parameter at a heating rate of about 5° K./minute is similar to that noted in FIG. 3 for a heating rate of about 60° K./minute. The addition of iron oxide significantly reduces the Vc parameter at pressures below 1.5 MPa $H_2$. However, for a heating rate of about 5° K./minute at $H_2$ pressures above 1.5 MPa, the Vc parameter is similar to, but still less than that of the untreated coal (comparative example).

In He, the Vc does not increase to the same extent with an increase in pressure as it does in $H_2$. The presence of iron oxide in an He atmosphere significantly reduces the plastic range (Tr–Ts) of the coal. In addition, the greater the loading of the iron oxide additives, the narrower the plastic range of the coal. In contrast, at a slow heating rate of for example about 5° K./minute, the plastic range at elevated pressures of $H_2$ in the presence of iron oxide iis wider than that of the untreated coal.

Figure 4:
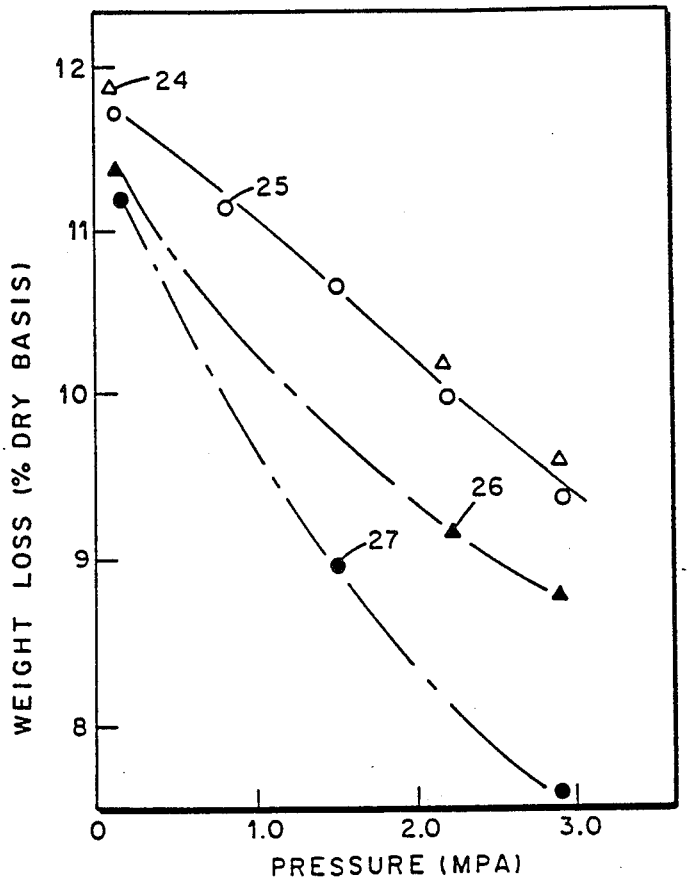
FIG. 4 is a graph which represents the influence of iron oxide additives on weight-loss during pyrolysis.

FIG. 4 shows the effect of $Fe_2O_3$ addition on weight loss during pyrolysis in an $H_2$ or He atmosphere at a heating rate of about 60° K./minute when heated to a maximum temperature of about 900° K. and compared to untreated coal similarly heated in $H_2$, line 24 and in He, line 25. Addition of about 23.2 wt % $Fe_2O_3$ significantly reduces the extent of weight loss at all pressures. However, this effect is more pronounced at elevated pressures. In addition, the weight loss is lower in He, line 27 than it is in $H_2$, line 26.

The influences of $Fe_2O_3$ addition at a heating rate of about 5° K./minute when heated to a maximum temperature of about 913° K. in He are qualitatively similar to the influences of $Fe_2O_3$ at a heating rate of about 60° K./minute. The weight loss parameter is slightly reduced in the presence of $Fe_2O_3$ in an He atmosphere. However in $H_2$, at a heating rate of about 5° K./minute, the extent of weight loss is not a function of $H_2$ pressure.

The total gas yield, in mmole/gram coal measured at standard temperature and pressure (STP), produced by pyrolysis of coal, which is heated rapidly to about 823° K. at a pressure of about 2.9 MPa $N_2$ with a soak time of about 30 minutes in the presence and in the absence of $Fe_2O_3$, is listed in Table 2. The results indicate that the presence of $Fe_2O_3$ reduces the yield of $H_2$, hydrocarbon gases ($C_1$ through $C_4$), CO and $H_2S$. Although the yield of CO decreases, the yield of $CO_2$ increases slightly in the presence of $Fe_2O_3$.

TABLE 2

Effect of $Fe_2O_3$ on Total Gaseous Product Yield (mmole/g coal, STP) (823° K., 30 min, 2.9 MPa $N_2$).

| Species | (Comparative Example) Coal (1) | Coal + $Fe_2O_3$ (23.2 wt %) (2) | Ratio (2/1) |
|---|---|---|---|
| $H_2$ | 0.124 | 0.047 | 0.377 |
| $C_2H_6$ | 0.059 | 0.02 | 0.347 |
| $CH_4$ | 0.134 | 0.101 | 0.827 |
| $C_3$–$C_4$ | 0.212 | 0.043 | 0.202 |
| $C_2H_4$ | <0.001 | <0.001 | — |
| $H_2S$ | 0.003 | 0.001 | 0.3 |
| $CO_2$ | 0.004 | 0.005 | 1.2 |
| CO | 0.018 | 0.008 | 0.4 |
| Total | 0.55 | 0.224 | 0.4 |

A series of x-ray diffraction (XRD) patterns was generated from the products of the present invention to examine the fate of the added iron oxides pyrolyzed with coal in various atmospheres. The compositions of the resulting iron species identified by XRD are summarized in Table 3, for an He atmosphere, and in Table 4, for an $H_2$ atmosphere, and are a function of pyrolysis conditions in the presence of $Fe_2O_3$. Referring to Table 3, the final iron oxide product is not a function of the heating rate (5° or 60° K./minute) or pressure (0.1 to 3.6 MPa). Co-pyrolysis of coal in He with hematite at a temperature of about 803° K. results in the formation of magnetite. The transformation of hematite to magnetite is also evident from a visible examination of the reactants and products. Hematite is a bright red material, commonly referred to as "red-mud", which turns black when transformed to magnetite. In addition, the data in Table 3 indicate that in the presence of coal, the transformation of $Fe_2O_3$ to $Fe_3O_4$ occurs in a temperature range of about 763° K. to about 803° K.

TABLE 3

Summary of Results of XRD Studies on the Products of Co-Carbonization of Coal and Hematite in He.

| Experimental Conditions | | | | |
|---|---|---|---|---|
| Heating Rate (°K./min) | Maximum Temperature (°K.) | Pressure Range (MPa) | Initial Reactant(s) | Final Products |
| 5 or 6 | 803, 823, or 923 | 0.1 to 3.6 | $Fe_2O_3$ Alone | $Fe_2O_3$ |
| 5 or 6 | 803 | 0.1 to 3.6 | Coal + $Fe_2O_3$ | $Fe_3O_4$ |
| 5 or 6 | 763 | 0.1 to 3.6 | Coal + $Fe_2O_3$ | $Fe_2O_3$ |

Referring to Table 4, the composition of the products of pyrolysis of coal with $Fe_2O_3$ in an $H_2$ atmosphere is a function of the heating rate, which can be expressed in terms of the residence time and the maximum temperature. The reduction of $Fe_2O_3$ to $Fe_3O_4$ in an $H_2$ atmosphere is thermodynamically feasible even at room temperature, where $\Delta G$ is negative at 298° K. This reduction reaction is noted to be a function of heating rate and pressure, and it is suggested in McKewan, *Trans. Metal Soc. AIME,* 224, Apr., 1962*a;* McKewan, *Trans. Metal Soc. AIME,* 224, Feb., 1962*b;* McKewan, *Trans. Metal Soc. AIME,* 221, Feb., 1961; and McKewan, *Trans. Metal Soc. AIME,* 218, Feb., 1960, which are incorporated by reference herein, that the kinetics of the reduction reaction determine the product composition.

Table 4 shows that $Fe_2O_3$ is reduced to $Fe_3O_4$ at a heating rate of about 60° K./minute in $H_2$, whether or not coal is present. At a heating rate of 5° K./minute in $H_2$, at all pressures, $Fe_2O_3$ is reduced ot magnetite and α-iron at 623° K. and reduced to FeO and α-iron at 903° K.

TABLE 4

Summary of Results of XRD Studies on the Products of Co-Carbonization of Coal and Hematite in $H_2$.

| Experimental Conditions | | | | |
|---|---|---|---|---|
| Heating Rate (°K./min) | Maximum Temperature (°K.) | Pressure Range (MPa) | Initial Reactant(s) | Final Products |
| 60 | 903 | 0.1 to 2.9 | $Fe_2O_3$ Alone | $Fe_3O_4$ |
| 60 | 903 | 0.1 to 2.9 | Coal + $Fe_2O_3$ | $Fe_3O_4$ |
| 5 | 623 | 1.5 | Coal + $Fe_2O_3$ | Fe and $Fe_2O_3$ |
| 5 | 903 | 0.1 to 3.6 | Coal + $Fe_2O_3$ | Fe and FeO |
| 5 | 623 | 1.5 | Coal + $Fe_2O_3$ | Fe and $Fe_3O_4$ |

Based on available literature, the reduction of $Fe_2O_3$ to Fe can occur by the following sequence of reactions: Reduction Sequences/Relative Rate $$3Fe_2O_3+H_2\rightarrow 2Fe_3O_4+H_2O \text{ (Fastest)} \quad (1)$$

$$Fe_3O_4+H_2\rightarrow 3FeO+H_2O \quad (2)$$

$$FeO+H_2\rightarrow Fe+H_2O \text{ (Slowest)} \quad (3)$$

Similar to the above reactions, CO can also reduce iron oxides. It should be noted that the relative rate of reduction of iron in reaction (1) is faster than the reduction in the subsequent steps of reactions (2) and (3).

When $Fe_3O_4$ is pyrolyzed at a heating rate of about 60° K./minute in He, as shown in Table 5, or in $H_2$, as shown in Table 6, no change in the composition of $Fe_3O_4$ can be identified by XRD. No change is seen at about 3.6 MPa, which is the highest tested pressure of He. In contrast, as shown in Table 6, the reduction of $Fe_3O_4$ at a heating rate of about 5° K./minute in $H_2$ is a function of (a) the maximum temperature, and (b) the presence or absence of coal. For example, no significant reduction is noted when $Fe_3O_4$ alone is heated to about 623° K. at a pressure of about 2.9 MPa of $H_2$. However, at identical experimental conditions and at pressures of from about 0.1 to 2.9 MPa of $H_2$, magnetite is partly reduced to α-Fe when heated in the presence of coal. The data indicates that the presence of coal enhances the reduction of iron oxide to metallic iron. It is surprising that coal promotes the reduction process better than does 2.9 MPa pressure of $H_2$. This finding suggests that the hydrogen from coal pyrolysis is a more effective reducing agent for magnetite than gaseous $H_2$.

The co-carbonization of coal and magnetite in an $H_2$ atmosphere when heated to a maximum temperature of either about 823° K. or about 623° K. forms products which are identified as α-Fe and $Fe_3O_4$. The products formed when coal and magnetite are heated to a maximum temperature of about 903° K. are identified as α-Fe and FeO with no detectable $Fe_3O_4$ peaks present. This result can be explained by the observation that FeO is not a thermodynamically stable species below about 853° K.

The resulting iron can be separated from the other pyrolysis products by conventional techniques.

TABLE 5

Summary of Results of XRD Studies on the Products of Co-Carbonization of Coal and Magnetite in He.

| Experimental Conditions | | | | |
|---|---|---|---|---|
| Heating Rate (°K./min) | Maximum Temperature (°K.) | Pressure Range (MPa) | Initial Reactant(s) | Final Products |
| 5 or 60 | 903 | 0.1 to 2.9 | $Fe_3O_4$ Alone | $Fe_3O_4$ |
| 5 or 60 | 903 | 0.1 to 2.9 | Coal + $Fe_3O_4$ | $Fe_3O_4$ |

TABLE 6

Summary of Results of XRD Studies on the Products of Co-Carbonization of Coal with Magnetite in $H_2$.

| Experimental Conditions | | | | |
|---|---|---|---|---|
| Heating Rate (°K./min) | Maximum Temperature (°K.) | Pressure Range (MPa) | Initial Reactant(s) | Final Product(s) |
| 60 | 903 | 0.1 to 2.9 | $Fe_3O_4$ Alone | $Fe_3O_4$ |
| 60 | 903 | 0.1 to 2.9 | Coal + $Fe_3O_4$ | $Fe_3O_4$ |
| 5 | 623 | 0.1 to 2.9 | $Fe_3O_4$ Alone | $Fe_3O_4$ |
| 5 | 623 | 0.1 to 2.9 | Coal + $Fe_3O_4$ | α Fe and $Fe_3O_4$ |
| 5 | 823 | 0.1 to 2.9 | Coal + $Fe_3O_4$ | α Fe and $Fe_3O_4$ |

TABLE 6-continued

Summary of Results of XRD Studies on the Products of Co-Carbonization of Coal with Magnetite in $H_2$.

| Experimental Conditions | | | | |
|---|---|---|---|---|
| Heating Rate (°K./min) | Maximum Temperature (°K.) | Pressure Range (MPa) | Initial Reactant(s) | Final Product(s) |
| 5 | 903 | 2.9 | Coal + $Fe_3O_4$ | α Fe and FeO |

Devolatilization of coal in the presence of $Fe_2O_3$ reduces the yield of $H_2S$ as shown in Table 2. This reduction of $H_2S$ is paralleled by the formation of FeS (troilite), as identified by XRD. FeS peaks can be identified whenever coal is co-pyrolyzed with hematite or magnetite and can be shown to be independent of the heating rate or gas atmosphere utilized (data not shown separately on each of Tables 3–6).

Iron oxide additives can influence the thermoplastic properties of coal. Iron oxide can exert a physical influence on the coal-melt by serving as a "diluent". The presence of a diluent may facilitate evolution of the devolatilized products. As discussed previously, the diluent effect of an additive such as $SiO_2$ (comparative example) on the thermoplastic properties of coal is relatively small. Therefore, the observed substantial influence of iron oxide on the measured parameters may be attributed primarily to a chemical and/or catalytic effect on the pyrolysis reaction. Hematite or magnetite can have catalytic roles during the pyrolysis of coal by promoting solid formation at the expense of tar and hydrocarbon yields. Cypres et al, *Fuel*, Vol. 60, No. 9, p. 768 (1981); Cypres et al, *Fuel*, Vol. 60, No. 1, p. 33 (1981); and Cypres et al, *Fuel*, Vol. 59, No. 1, p. 48 (1980), which are incorporated by reference herein, suggest that iron oxide catalyzes the polymerization reactions of the intermediate products of pyrolysis, such as coal-melt, to produce char at the expense of the hydrocarbon gas and tar. As discussed previously, a minimum degree of fluidity is essential for the coal to swell and depletion of the liquid materials can explain why the thermoplastic properties are markedly reduced when coal is pyrolyzed in the presence of iron oxide.

Additionally, hematite can influence the thermoplastic properties of coal by chemically interacting with the pyrolysis products. The results of the present invention demonstrate that the transformation of hematite to magnetite reduces the plastic properties of coal in the temperature range of from about 763° K. to about 803° K., a region where softening of coal normally occurs. Transformation of hematite to magnetite by reaction (1) requires $H_2$, which is supplied by the available hydrogen in coal. This transfer of hydrogen not only facilitates reduction of $Fe_2O_3$ to $Fe_3O_4$ but also dramatically affects the nature of the thermoplastic properties of coal. In the absence of donor hydrogen to stabilize the generated free radicals, retrogressive reactions may set in producing relatively higher molecular weight materials. The reaction:

$$3Fe_2O_3+CO \rightarrow 2Fe_3O_4+CO_2 \quad (4)$$

can also reduce hematite to magnetite if enough CO is present. The reduction of hematite by the reaction:

$$3Fe_2O_3+C \rightarrow 2Fe_3O_4+CO \quad (5)$$

has not been reported to occur below 1,000° K.

The small restoration of the thermoplastic properties of coal in the presence of iron oxide at elevated pressures of $H_2$ can be explained by the theory that the presence of gas phase $H_2$ lowers the extent of retrogressive/polymerization reactions. The fluidity of the coal-melt is further enhanced when pyrolyzed at a heating rate of about 60° K./minute at elevated pressures of $H_2$ and results in restored Vs. Pyrolysis in $H_2$ at a heating rate of about 5° K./minute partly reduces iron oxides to elemental iron which then serves as a site for $H_2$ dissociation, as described in McKewan in the articles referred to above. The resulting hydrogenation reactions lead to the formation of a fluid system which also facilitates an increase in the $V_s$ parameter.

The presence of $Fe_2O_3$ or $Fe_3O_4$ additives results in an increase in solid yield, which is directly related to the reduced weight loss of coal during pyrolysis. This increase in solid formation was accompanied by a slight decrease in the total amount of light gases monitored, primarily $C_3$–$C_4$ and $C_2H_6$. The data suggest that char-forming reactions can be promoted by iron oxide and can facilitate increased (thermosetting) solid yield at the expense of formation of tars and light gases.

In the case of $Fe_2O_3$, a chemical role, namely, the conversion of $Fe_2O_3$ to $Fe_3O_4$ and consumption of $H_2$ in the process, may also influence the nature of the thermoplastic properties of coal. It is noted that at elevated pressures of $H_2$, depending on the composition of the additive ($Fe_2O_3$ or $Fe_3O_4$) utilized, the maximum swelling parameter (Vs %) was restored. The effect of pressure is to increase the fluidity of the coal melt. Therefore, at elevated pressure, the thermoplastic properties of the coal in the presence of the additives are determined by the balance between the decrease in fluidity caused by char-forming reactions promoted by the additives and the increased fluidity of the coal system induced by elevated pressure of $H_2$. At elevated pressures, the maximum swelling parameter is increased by $H_2$ which tends to (a) decrease the extent of char-forming reactions, and (b) reduce iron oxides to elemental iron which serves as a hydrogenation catalyst. This effect is enhanced at a longer residence time facilitated by a very slow heating rate, for example about 5° K./minute. The invention also establishes that the hydrogen from the pyrolysis of coal is more effective as a reducing agent for magnetite than gaseous $H_2$ alone.

An alternate embodiment of the present invention includes a method for producing a fuel from the pyrolysis of oil shale in the presence of iron oxide in an inert gas atmosphere. The method includes the steps of pulverizing oil shale, pulverizing iron oxide, mixing the pulverized oil shale and iron oxide, and heating the mixture in a gas atmosphere which is substantially inert to said mixture so as to form a gaseous, a liquid and a solid product.

The influence of an iron oxide additive, such as $Fe_2O_3$, on the gaseous $H_2S$ and liquid S yield of coal and oil shale pyrolysis can be seen by an examination of the data produced by experiments performed using a commercially available assay such as a Fischer assay system. In the tests, Pittsburgh No. 8 (hvAb) coal and Colo. Mahogany Zone oil shale were used as coal and oil shale samples, respectively. The influence of 20 wt % $Fe_2O_3$ on product yield and composition are shown in Tables 7 and 8, respectively.

TABLE 7

| Influence of Added $Fe_2O_3$ on Pyrolysis Products for Pittsburgh No. 8 Coal at 500° and 649° | | | | |
|---|---|---|---|---|
| | Comparative Example 100 g Pittsburgh No. 8 Coal (500° C.) | 100 g Pittsburgh No. 8 Coal + 21 wt % $Fe_2O_3$ (500° C.) | Comparative Example 100 g Pittsburgh No. 8 Coal (649° C.) | 100 g Pittsburgh No. 8 Coal + 21 wt % $Fe_2O_3$ (649° C.) |
| Total Gas (l) | 7.0 | 7.0 | 14.0 | 16.0 |
| Char Alone (wt %) | 75.3 | 78.2 | 68.6 | 66.5 |
| Tar (wt %) | 17.7 | 13.5 | 18.3 | 14.9 |
| Water (wt %) | 1.6 | 3.5 | 2.3 | 5.7 |
| Gas Composition (Vol. %) | | | | |
| $H_2$ | 11.6 | 16.1 | 20 | 31.6 |
| CO | 3.9 | 2.9 | 6.6 | 5.0 |
| $CO_2$ | 5.4 | 9.2 | 4.2 | 7.8 |
| $H_2S$ | 3.7 | 0.1 | 3.4 | 0.09 |
| COS | 0.39 | 0 | 0.22 | 0.01 |
| $H_2O$ | 0.25 | 0 | 0.5 | 0.5 |
| $CH_4$ | 49.8 | 45.9 | 49.8 | 41.4 |
| $C_2H_4$ | 1.33 | 1.5 | 1.5 | 1.0 |
| $C_2H_6$ | 11.2 | | 6.1 | 4.5 |
| $C_1$-$C_8$ (Total) | 75.4 | 71.7 | 68.2 | 54.9 |
| Tar Composition (wt %) | | | | |
| Ash | 0.03 | 0 | 0.04 | 0.1 |
| C | 80.7 | 84.0 | 77.2 | 85.4 |
| H | 9.1 | 9.3 | 8.6 | 8.7 |
| S | 0.72 | 0.58 | 0.85 | 0.5 |
| N | 1.59 | 1.38 | 1.34 | .1.8 |
| O | 7.89 | 4.73 | 12.0 | 3.6 |
| H/C (Atomic) | 1.35 | 1.32 | 1.33 | 1.22 |
| Btu/lb | 15,926 | 16,250.0 | 15,222 | 16,863 |
| Char Composition (daaf, wt %) | | | | |
| C | 83.4 | 83.6 | 92.5 | |
| H | 3.05 | 3.3 | 2.3 | |
| N | 2.2 | 1.9 | 1.8 | |
| S | 1.98 | 2.3 | 1.5 | |
| VM | | — | | |
| H/C | | 0.47 | | |
| Btu/lb | 13,945 | — | 14,330 | |

TABLE 8

| Influence of Added $Fe_2O_3$ on Shale Retort Products for Colorado Oil Shale (Mahogany Zone) at 500° C. | | |
|---|---|---|
| | (Comparative Example) Colorado Shale 100 g | 100 g Colorado Shale + 20 gm $Fe_2O_3$ |
| Total Gas (l) | 4.6 | 4.7 |
| Oil (wt %) | 12.3 | 11.6 |
| Water (wt %) | 0.6 | 2.0 |
| Gas Composition (Vol. %) | | |
| $H_2$ | 21.13 | 33.5 |
| CO | 3.27 | 3.0 |
| $CO_2$ | 22.03 | 19.8 |
| $H_2S$ | 5.74 | 0.16 |
| COS | 0.33 | 0.0 |
| $H_2O$ | .336 | 0.37 |
| $CH_4$ | 21.77 | 16.1 |
| $C_2H_4$ | 1.79 | 2.0 |
| $C_2H_6$ | 7.12 | 4.9 |
| $C_1$-$C_8$ | 47.15 | 43.5 |
| Tar Composition (wt %) | | |
| Ash | 0.01 | 0.02 |
| C | 83.4 | 84.5 |
| H | 10.7 | 10.7 |
| S | 1.05 | 0.7 |
| N | 2.60 | 2.2 |
| O (By Difference) | 3.25 | 1.9 |
| H/C (Atomic) | 1.56 | 1.52 |
| Btu/lb | 18,118 | 18,294 |

The method of the present invention significantly reduces the gaseous $H_2S$ and COS yield for both coal and oil shale. In addition, the liquid S contents are significantly reduced when pyrolyzed with $Fe_2O_3$.

Additional advantages of the $Fe_2O_3$ additive are reflected in the improved quality of the liquid product generated by the method of the present invention. The improved liquid product exhibits a decrease in oxygen content and an increase in heating value. Addition of a $SiO_2$ additive to the pyrolysis reaction does not result in the improvements generated by the present invention as discussed above.

What is claimed is:

1. A method for producing a fuel from the pyrolysis of coal or oil shale comprising the steps of:

(a) pulverizing coal or oil shale, (b) pulverizing iron oxide, (c) mixing the pulverized coal or oil shale and the pulverized iron oxide, (d) subjecting the pulverized mixture to a mechanical load, and (e) heating the mechanically loaded mixture to pyrolysis temperature in a gas atmosphere which is substantially inert to said mixture, so as to substantially prevent said mixture from swelling, to form a product fuel.

2. A method according to claim 1, wherein coal is pulverized, mixed with pulverized iron oxide, and heated in a substantially inert gas atmosphere to produce a product fuel.

3. A method according to claim 2, wherein said iron oxide is hematite ($Fe_2O_3$), magnetite ($Fe_3O_4$) or a mixture thereof.

4. A method according to claim 2, wherein said iron oxide is added in an amount sufficient to provide about 0.72 millimole Fe per gram coal.

5. A method according to claim 2, wherein said iron oxide is added in an amount sufficient to provide about 2.9 millimole Fe per gram coal.

6. A method according to claim 2, wherein said gas atmosphere comprises hydrogen ($H_2$) at superatmospheric pressure.

7. A method according to claim 2, wherein said gas atmosphere comprises helium (He) at a pressure within a range of from about 1 to about 3.6 atmospheres.

8. A method according to claim 2, wherein said gas atmosphere comprises nitrogen ($N_2$) at a pressure of up to about 2.9 atmospheres.

9. A method according to claim 2, wherein said heating is effected at a heating rate of about 5° K./minute.

10. A method according to claim 2, wherein said heating is effected at a heating rate of about 60° K./minute.

11. A method according to claim 1, wherein oil shale is pulverized, mixed with pulverized iron oxide and heated in a substantially inert gas atmosphere to produce a product fuel.

12. A method according to claim 11, wherein said iron oxide comprises hematite ($Fe_2O_3$).

13. A method according to claim 12, wherein said hematite ($Fe_2O_3$) comprises about 20 weight % of said mixture.

14. A method according to claim 1, wherein said coal or oil shale is pulverized to less than 150 μm size and said iron oxide is pulverized to less than 74 μm size.

15. A method according to claim 14, wherein said coal or oil shale is pulverized to less than 74 μm size and said iron oxide is pulverized to less than 38 μm size.

16. A method according to claim 1, wherein said pulverized mixture is subjected to a mechanical load of at least about 5 kPa.

17. A method according to claim 16, wherein said pulverized mixture is subjected to a mechanical load of at least about 10 kPa.

18. A method for reducing the swelling of coal during pyrolysis comprising the steps of:

(a) pulverizing coal, (b) pulverizing iron oxide, (c) mixing said pulverized coal and said pulverized iron oxide, (d) subjecting the pulverized mixture to a mechanical load, and (e) heating said mechanically loaded mixture to pyrolysis temperature in a gas atmosphere which is substantially inert to said mixture, so as to substantially prevent said mixture from swelling.

19. A method according to claim 18, wherein said iron oxide is hematite ($Fe_2O_3$), magnetite ($Fe_3O_4$) or a mixture thereof.

* * * * *